US009365951B2

(12) United States Patent
Lamanac

(10) Patent No.: US 9,365,951 B2
(45) Date of Patent: Jun. 14, 2016

(54) NEGATIVE POLARITY ON THE NANOFIBER LINE

(71) Applicant: Kimberly-Clark Worldwide, Inc., Neenah, WI (US)

(72) Inventor: Anthony L. Lamanac, Woodstock, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 329 days.

(21) Appl. No.: 14/168,064

(22) Filed: Jan. 30, 2014

(65) Prior Publication Data

US 2015/0211149 A1 Jul. 30, 2015

(51) Int. Cl.

| | |
|---|---|
| ***D01D 7/00*** | (2006.01) |
| ***D01D 5/18*** | (2006.01) |
| ***D01D 5/00*** | (2006.01) |

(52) U.S. Cl.

CPC ..... *D01D 7/00* (2013.01); *D01D 5/0061* (2013.01); *D01D 5/18* (2013.01)

(58) Field of Classification Search

None

See application file for complete search history.

(56) References Cited

U.S. PATENT DOCUMENTS

| | | | |
|---|---|---|---|
| 4,041,203 | A | 8/1977 | Brock et al. |
| 4,215,682 | A | 8/1980 | Kubik et al. |
| 4,374,888 | A | 2/1983 | Bornslaeger |
| 4,375,718 | A | 3/1983 | Wadsworth et al. |
| 4,588,537 | A | 5/1986 | Klaase et al. |
| 4,592,815 | A | 6/1986 | Nakao |
| 4,741,944 | A | 5/1988 | Jackson et al. |
| 4,766,029 | A | 8/1988 | Brock et al. |
| 4,937,299 | A | 6/1990 | Ewen et al. |
| 5,169,706 | A | 12/1992 | Collier, IV et al. |
| 5,213,881 | A | 5/1993 | Timmons et al. |
| 5,218,071 | A | 6/1993 | Tsutsui et al. |
| 5,272,236 | A | 12/1993 | Lai et al. |
| 5,278,272 | A | 1/1994 | Lai et al. |
| 5,401,446 | A | 3/1995 | Tsai et al. |
| 5,464,688 | A | 11/1995 | Timmons et al. |
| 5,539,056 | A | 7/1996 | Yang et al. |
| 5,540,332 | A | 7/1996 | Kopacz et al. |

(Continued)

FOREIGN PATENT DOCUMENTS

| | | |
|---|---|---|
| WO | WO 2012109240 A2 | 8/2012 |
| WO | WO 2012109240 A3 | 8/2012 |

(Continued)

OTHER PUBLICATIONS

Branham et al., U.S. Appl. No. 13/953,097, filed Jul. 23, 2013, Solution Spinning of Fibers.

(Continued)

*Primary Examiner* — Mary F Theisen

(74) *Attorney, Agent, or Firm* — Dority & Manning, P.A.

(57) ABSTRACT

A centrifugal spinning system and method for forming a fibrous web containing nanofibers, microfibers, or a combination thereof from a molten polymer composition or an aqueous spinning solution is provided. Through careful control over the arrangement of the system, a fibrous web can be formed that is relatively defect free. To help accomplish this feature, at least two centrifugal spinning chambers, each containing a charged forming plate, are utilized. To minimize the present of defects in the fibrous web, the charge applied to the first spinning chamber has a polarity that is opposite the polarity of the charge applied to the second spinning chamber.

26 Claims, 7 Drawing Sheets

(56) References Cited

U.S. PATENT DOCUMENTS

| | | | | |
|---|---|---|---|---|
| 5,596,052 | A | 1/1997 | Resconi et al. | |
| 5,667,635 | A | 9/1997 | Win et al. | |
| 5,888,524 | A | 3/1999 | Cole | |
| 6,028,018 | A | 2/2000 | Amundson et al. | |
| 6,440,437 | B1 | 8/2002 | Krzysik et al. | |
| 6,500,563 | B1 | 12/2002 | Datta et al. | |
| 6,604,925 | B1 | 8/2003 | Dubson | |
| 6,616,435 | B2 | 9/2003 | Lee et al. | |
| 7,980,838 | B2 | 7/2011 | Park | |
| 8,268,224 | B2 | 9/2012 | Kohinata et al. | |
| 2004/0180199 | A1 | 9/2004 | Kang | |
| 2004/0207126 | A1 | 10/2004 | Czado | |
| 2006/0138710 | A1 | 6/2006 | Bryner et al. | |
| 2009/0122748 | A1 | 5/2009 | Gourhant et al. | |
| 2009/0160099 | A1 | 6/2009 | Huang | |
| 2010/0013126 | A1 | 1/2010 | Ishaque et al. | |
| 2011/0014542 | A1* | 1/2011 | Sumida | D01D 5/0061 429/480 |
| 2012/0003893 | A1 | 1/2012 | Branham | |
| 2012/0292795 | A1 | 11/2012 | Peno et al. | |
| 2012/0292796 | A1 | 11/2012 | Peno et al. | |
| 2012/0292810 | A1 | 11/2012 | Peno et al. | |
| 2012/0294966 | A1 | 11/2012 | Peno et al. | |
| 2012/0295021 | A1 | 11/2012 | Peno et al. | |
| 2012/0304613 | A1 | 12/2012 | Peno et al. | |
| 2013/0011508 | A1* | 1/2013 | Kim | D01D 5/0061 425/174.8 E |

FOREIGN PATENT DOCUMENTS

| | | | |
|---|---|---|---|
| WO | WO 2012109251 | A2 | 8/2012 |
| WO | WO 2012109251 | A3 | 8/2012 |
| WO | WO 2013096672 | A1 | 6/2013 |

OTHER PUBLICATIONS

Branham et al., U.S. Appl. No. 14/041,205, filed Sep. 30, 2013, Fiber having a Nanohair Surface Technology.
Abstract of Japanese Patent—JP2012167408, Sep. 6, 2012, 1 page.
Abstract of Taiwanese Patent—TW200949028, Dec. 1, 2009, 1 page.
Related U.S. Patent Application Form.
Abstract of Chinese Patent—CN101012576, Aug. 8, 2007, 1 page.
Machine Translation of KR100562010, Mar. 22, 2006, 17 pages.
Machine Translation of KR100780346, Nov. 30, 2007, 9 pages.
International Search Report and Written Opinion for PCT/IB2015/050281 dated May 28, 2015, 10 pages.

* cited by examiner

NEGATIVE POLARITY ON THE NANOFIBER LINE

BACKGROUND OF THE INVENTION

Centrifugal spinning has become an important process for forming fibers, such as nanofibers and microfibers, as it allows the formation of fibers from either a molten polymer composition or from an aqueous spinning solution. Such systems and methods are an improvement over, for example, electrospinning technology, in that the use of organic solvents is avoided with centrifugal spinning. However, fibrous sheets or webs formed via centrifugal spinning technology often exhibit defects as the fibrous sheets or webs are formed on a collecting surface of a centrifugal spinning unit or as the sheets or webs are removed from the centrifugal spinning unit onto a roll via a winder. As such, a need exits for a system and method of forming fibrous sheets or webs via centrifugal spinning that minimizes the amount of defects in the fibrous sheets or webs.

SUMMARY OF THE INVENTION

In accordance with one embodiment of the present invention, a fiber-forming system for forming a fibrous web is provided. The system includes a collection surface, a first fiber-forming device comprising a charged first forming plate positioned beneath the collection surface, and a second fiber-forming device comprising a charged second forming plate positioned beneath the collection surface. The first forming plate and the second forming plate exhibit opposing charge polarities.

In accordance with another embodiment of the present invention, a method for forming a fibrous web on a collection surface via a fiber-forming system is disclosed. The method includes introducing a first material to a first fiber-forming device and introducing a second material to a second fiber-forming device. The method further includes positioning a first forming plate beneath the collection surface, where the first forming plate is associated with the first fiber-forming device, and charging the first forming plate to a first charge via a first voltage source. In addition, the method includes positioning a second forming plate beneath the collection surface, where the second forming plate is associated with the second fiber-forming device, and charging the second forming plate to a second charge via a second voltage source, where the first forming plate and the second forming plate exhibit opposing charge polarities. The method also includes drawing a first group of fibers from the first fiber-forming device and a second group of fibers from the second fiber-forming device, and collecting the first group of fibers and the second group of fibers on the collection surface.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which:

FIG. 1(*b*) illustrates a cross-sectional side view of the rotating spin disk of FIG. 1(*a*);

DETAILED DESCRIPTION OF REPRESENTATIVE EMBODIMENTS

Definitions

Figure 1A:
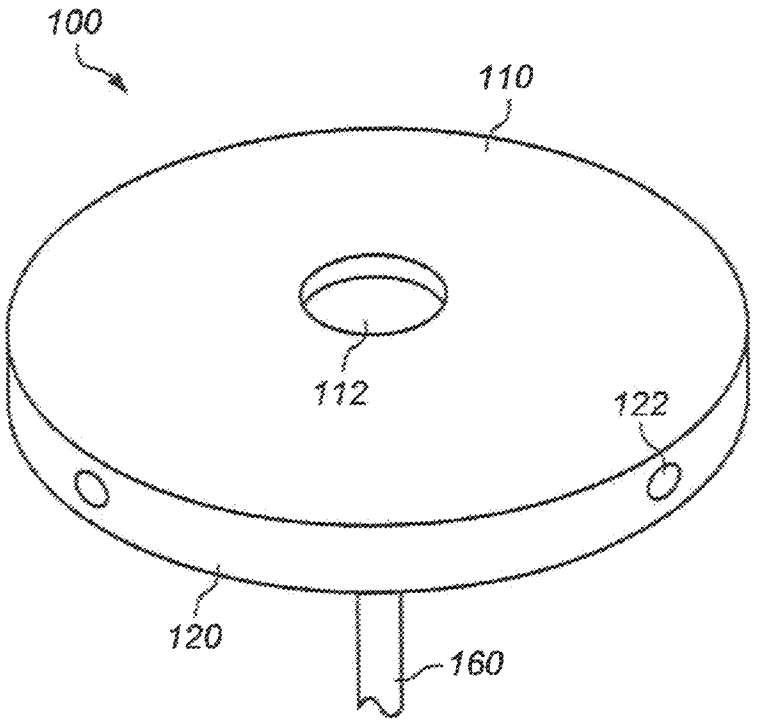
FIG. 1(*a*) illustrates a perspective view of an embodiment of rotating spin disk.

As used herein, the term "fibers" refer to elongated structures having a definite length or that are substantially continuous in nature. The fibers may be, for example, "nanofibers" or "microfibers." The term "nanofibers" generally refers to fibers having an average diameter of less than about 1 micrometer, in some embodiments about 800 nanometers or less, in some embodiments from about 5 nanometers to about 500 nanometers, and in some embodiments, from about 10 nanometers to about 100 nanometers, while the term "microfibers" generally refers to fibers having an average diameter of from about 1 micrometer to about 100 micrometers, in some embodiments about 2 micrometers to about 50 micrometers, in some embodiments from about 3 micrometers to about 40 micrometers, and in some embodiments, from about 5 micrometers to about 25 micrometers.

As used herein, the term "meltblown" web generally refers to a nonwoven web that is formed by a process in which a molten thermoplastic material is extruded through a plurality of fine, usually circular, die capillaries as molten fibers into converging high velocity gas (e.g., air) streams that attenuate the fibers of molten thermoplastic material to reduce their diameter. Thereafter, the meltblown fibers are carried by the high velocity gas stream and are deposited on a collecting surface to form a web of randomly dispersed meltblown fibers.

As used herein, the term "spunbond" web generally refers to a nonwoven web containing substantially continuous filaments. The filaments are formed by extruding a molten thermoplastic material from a plurality of fine, usually circular, capillaries of a spinneret with the diameter of the extruded filaments then being rapidly reduced as by, for example, eductive drawing and/or other well-known spunbonding mechanisms.

As used herein, the terms "machine direction" or "MD" generally refers to the direction in which a material (e.g., a fibrous sheet or web) is produced.

DETAILED DESCRIPTION

Reference now will be made in detail to various embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention covers such modifications and variations within the scope of the appended claims and their equivalents.

Generally speaking, the present invention is directed to a centrifugal spinning system and method for forming a sheet or web of fibers (e.g., nanofibers, microfibers, etc.) from a polymer composition. The present inventors have discovered that through careful control over the arrangement of the system, a nonwoven fibrous sheet or web can be formed that is relatively defect free. For instance, at least two fiber-forming devices or banks can be utilized, and instead of the at least two fiber-forming devices or banks including charged forming plates having the same polarity, such as a positive polarity, the charge applied to the first fiber-forming device has a polarity that is opposite the polarity of the charge applied to the second fiber-forming device. For instance, the first forming plate associated with the first fiber-forming device or bank can have a positive charge applied via a positive power supply, and the second forming plate associated with the second fiber-forming device or bank can have a negative charge applied via a negative power supply. Alternatively, the first forming plate associated with the first fiber-forming device or bank can have a negative charge applied via a negative power supply, and the second forming plate associated with the second fiber-forming device or bank can have a positive charge applied via a positive power supply. Further, if more than two fiber-forming devices are used, each fiber-forming device can have a polarity that is opposite in charge to any fiber-forming devices or banks adjacent to it as determined by the voltage applied to each forming plate. The fiber-forming devices can be meltblown, spunbond, or centrifugal spinning devices.

In one particular embodiment, to help accomplish this feature, at least two fiber-forming devices can be used, where the fiber-forming devices are centrifugal spinning chambers. At least two centrifugal spinning chambers are utilized, and instead of the at least two centrifugal spinning chambers including charged forming plates having the same polarity, such as a positive polarity, the charge applied to the first chamber has a polarity that is opposite the polarity of the charge applied to the second chamber. For instance, the first forming plate in the first centrifugal spinning chamber can have a positive charge applied via a positive power supply, and the second forming plate in the second centrifugal spinning chamber can have a negative charge applied via a negative power supply. Alternatively, the first forming plate in the first centrifugal spinning chamber can have a negative charge applied via a negative power supply, and the second forming plate in the second centrifugal spinning chamber can have a positive charge applied via a positive power supply. Further, if more than two centrifugal spinning chambers are used, each centrifugal spinning chamber can have a polarity that is opposite in charge to any centrifugal spinning chambers adjacent to it as determined by the voltage applied to each forming plate.

The present inventors have discovered that by configuring the polarity of each of the centrifugal spinning chambers as described above, a fibrous sheet or web can be formed having a substantially defect-free surface compared to a fibrous sheet or web formed by conventional methods, where both centrifugal spinning chambers are positively charged. In such an arrangement, when the charged fibrous sheet or web enters and leaves the centrifugal spinning unit, the fibers in the sheet are naturally attracted to a grounded surface, and such interaction causes formation defects in the sheet or web. Potential defects include loose or picked fibers that form holes or light spots in the resulting sheet or web due to clumping of such fibers as they are pulled away from the sheet or web and adhere to un-insulated, grounded metal on a frame of the centrifugal spinning unit. The defects can appear as irregular, circular, or "eye-brow" shaped imperfections in the sheet or web. In contrast, the charge arrangement of the present invention improves fiber laydown and web formation. In addition, the present inventors have found that placing a metallic sheet adjacent the second centrifugal spinning chamber along the machine direction of the centrifugal spinning unit where the fibrous sheet or web exits the centrifugal spinning chambers can dissipate the charge on the fibrous sheet or web caused by the charged forming plates. Such a configuration eliminates defects in the fibrous sheet or web caused by the attraction of the fibrous sheet or web to the grounded surface of the centrifugal spinning unit. Likewise, a discharge bar can also be used between centrifugal spinning chambers to eliminate a charge on the fibrous sheet or web as it passes between multiple centrifugal spinning chambers in the machine direction.

Various embodiments of the present invention will now be described in more detail. First, the polymer composition used in the method of forming a fibrous sheet or web via the system generally described above is discussed, followed by a detailed description of the centrifugal spinning system and method.

I. Polymer Composition

A. Thermoplastic Polymer

Although any suitable polymer can be utilized in the centrifugal spinning system of the present invention, in order to provide adequate thermal and mechanical properties, it is generally desired that thermoplastic polymers form a substantial portion of the fibers formed used. That is, thermoplastic polymers may constitute about 70 wt. % or more, in some embodiments about 75 wt % or more, and in some embodiments, from about 80 wt. % to about 99.9 wt. % of the fibers formed. In this regard, the polymer composition may likewise contain from about 85 wt. % to about 99 wt. %, in some embodiments from about 90 wt. % to about 98.5 wt. % of thermoplastic polymers.

Any of a variety of different polymers or blends of polymers may be employed in the present invention. Exemplary polymers may include, for instance, polyolefins, polytetrafluoroethylene, polyesters (e.g., polyethylene terephthalate, polylactic acid, etc.), polyvinyl acetate, polyvinyl chloride acetate, polyvinyl butyral, acrylic resins, (e.g., polyacrylate, polymethylacrylate, polymethylmethacrylate, etc.), polyamides (e.g., nylon), blends thereof, and so forth. Polyolefins may be particularly suitable for use in the present invention. When employed, the polyolefin may have a melting temperature of from about 100° C. to about 220° C., in some embodiments from about 120° C. to about 200° C., and in some embodiments, from about 140° C. to about 180° C., such as determined using differential scanning calorimetry ("DSC") in accordance with ASTM D-3417. Suitable polyolefins may, for instance, include ethylene polymers (e.g., low density polyethylene ("LDPE"), high density polyethylene ("HDPE"), linear low density polyethylene ("LLDPE"), etc.), propylene homopolymers (e.g., syndiotactic, atactic, isotactic, etc.), propylene copolymers, and so forth. In one particular embodiment, the polymer is a propylene polymer, such as homopolypropylene or a copolymer of propylene. The propylene polymer may, for instance, be formed from a substantially isotactic polypropylene homopolymer or a copolymer containing equal to or less than about 10 wt. % of other monomers, i.e., at least about 90% by weight propylene. Such homopolymers may have a melting point of from about 140° C. to about 170° C. Commercially available propylene homopolymers may include, for instance, Metocene™ MF650Y and MF650X, which are available from Basell Polyolefins.

Of course, other polyolefins may also be employed in the composition. In one embodiment, for example, the polyolefin may be a copolymer of ethylene or propylene with another α-olefin, such as a $C_3$-$C_{20}$ α-olefin or $C_3$-$C_{12}$ α-olefin. Specific examples of suitable α-olefins include 1-butene; 3-methyl-1-butene; 3,3-dimethyl-1-butene; 1-pentene; 1-pentene with one or more methyl, ethyl or propyl substituents; 1-hexene with one or more methyl, ethyl or propyl substituents; 1-heptene with one or more methyl, ethyl or propyl substituents; 1-octene with one or more methyl, ethyl or propyl substituents; 1-nonene with one or more methyl, ethyl or propyl substituents; ethyl, methyl or dimethyl-substituted 1-decene; 1-dodecene; and styrene. Particularly desired α-olefin comonomers are 1-butene, 1-hexene and 1-octene. The ethylene or propylene content of such copolymers may be from about 60 mole % to about 99 mole %, in some embodiments from about 80 mole % to about 98.5 mole %, and in some embodiments, from about 87 mole % to about 97.5 mole %. The α-olefin content may likewise range from about 1 mole % to about 40 mole %, in some embodiments from about 1.5 mole % to about 15 mole %, and in some embodiments, from about 2.5 mole % to about 13 mole %.

Exemplary olefin copolymers for use in the polymer composition include ethylene-based copolymers available under the designation EXACT™ from ExxonMobil Chemical Company of Houston, Tex. Other suitable ethylene copolymers are available under the designation ENGAGE™, AFFINITY™, DOWLEX™ (LLDPE) and ATTANE™ (ULDPE) from Dow Chemical Company of Midland, Mich. Other suitable ethylene polymers are described in U.S. Pat. No. 4,937,299 to Ewen, et al.; U.S. Pat. No. 5,218,071 to Tsutsui, et al.; U.S. Pat. No. 5,272,236 to Lai, et al.; and U.S. Pat. No. 5,278,272 to Lai, et al. Suitable propylene copolymers are also commercially available under the designations VISTAMAXX™ from ExxonMobil Chemical Co. of Houston, Tex.; FINA™ (e.g., 8573) from Atofina Chemicals of Feluy, Belgium; TAFMER™ available from Mitsui Petrochemical Industries; and VERSIFY™ available from Dow Chemical Co. of Midland, Mich. Suitable polypropylene homopolymers may include Exxon Mobil 3155 polypropylene, Exxon Mobil Achieve™ resins, and Total M3661 PP resin. Other examples of suitable propylene polymers are described in U.S. Pat. No. 6,500,563 to Datta, et al.; U.S. Pat. No. 5,539,056 to Yana, et al.; and U.S. Pat. No. 5,596,052 to Resconi, et al.

B. Charge Stabilizer

As an electrostatic charge is applied to the fibers as they are formed in the centrifugal spinning unit of the present invention (e.g., to the collection surface via a perforated plate) and because the thermoplastic polymer can act as an insulator, thus limiting the ability of the charge to be accepted by the polymer composition, a charge stabilizer may be employed in the polymer composition to ameliorate the insulating effect of the thermoplastic polymer. When employed, such charge stabilizers may be present in any effective amount needed, such as from about 0.001 wt. % to about 10 wt. %, in some embodiments from about 0.005 wt. % to about 5 wt. %, and in some embodiments, from about 0.01 wt. % to about 2.5 wt. % of the polymer composition.

While any suitable charge stabilizer may generally be employed in the present invention, particularly suitable stabilizers include salts or esters of organic carboxylic acids. For example, the stabilizer may be a salt of an organic carboxylic acid represented by the formula $R_1[C(O)O^-]_nM^{n+}$, wherein M is a metal ion (e.g., alkali metal ion, such as sodium or potassium), n is a number representing the valence of the metal ion, and $R_1$ is an organic radical containing from 5 to 30 carbon atoms, in some embodiments from 8 to 22 carbon atoms, and in some embodiments, from 12 to 22 carbon atoms (e.g., aliphatic hydrocarbyl group). Examples of such salts may include, for instance, an alkali metal salt of a $C_6$-$C_{30}$ fatty acid, such as sodium oleate, potassium oleate, sodium stearate, potassium stearate, sodium laurate, potassium laurate, sodium linoleate, etc. Esters (e.g., monoesters, diesters, etc.) of an organic carboxylic acid may also be employed, such as fatty acid esters (e.g., methyl stearate, ethyl stearate, methyl oleate, ethyl oleate, n-butyl oleate, t-butyl oleate, methyl laurate, ethyl laurate, methyl linoleate, ethyl linoleate, methyl palpitate, etc.); aromatic acid esters (e.g., methyl phthalate, ethyl phthalate, methoxy ethyl phthalate, ethoxyethylphthalate, di(ethoxyalkyl)phthalate, di(butoxyethyl)phthalate, di(butoxyethoxyethy)phthalate, dioctyl phthalate, dibutylterephthalate, etc.); and so forth.

C. Other Components

Although not required, a variety of other additives may also be employed in the polymer composition, such as catalysts, antioxidants, peroxides, surfactants, spinning aids, waxes, nucleating agents, particulates, and other materials added to enhance processability or impart other properties to the fibers. When employed, such additives may be present in any effective amount needed, such as from about 0.001 wt. % to about 10 wt. %, in some embodiments from about 0.005 wt. % to about 5 wt. %, and in some embodiments, from about 0.01 wt. % to about 2.5 wt. % of the polymer composition.

II. Blending

The components of the polymer composition may be blended together for spinning using any of a variety of known techniques, including melt blending, solution blending, etc. In one embodiment, for example, the components (e.g., polymer, charge stabilizer, antioxidant, etc.) may be supplied to a melt blending device separately or in combination. For instance, the components may first be dry mixed together to form an essentially homogeneous dry mixture, and they may likewise be supplied either simultaneously or in sequence to a melt processing device that dispersively blends the materials. Batch and/or continuous melt processing techniques may be employed. For example, a mixer/kneader, Banbury mixer, Farrel continuous mixer, single-screw extruder, twin-screw extruder, roll mill, etc., may be utilized to blend and melt process the materials. Particularly suitable melt processing devices may be a co-rotating, twin-screw extruder (e.g., ZSK-30 extruder available from Werner & Pfleiderer Corporation of Ramsey, N.J. or a Thermo Prism™ USALAB 16 extruder available from Thermo Electron Corp., Stone, England). Such extruders may include feeding and venting ports and provide high intensity distributive and dispersive mixing. For example, the components may be fed to the same or different feeding ports of the twin-screw extruder and melt blended to form a substantially homogeneous molten mixture. If desired, other additives may also be injected into the polymer melt and/or separately fed into the extruder at a different point along its length.

The degree of shear/pressure and heat may also be controlled to ensure sufficient dispersion. For example, blending typically occurs at a temperature of from about 180° C. to about 260° C., in some embodiments from about 185° C. to about 250° C., and in some embodiments, from about 190° C. to about 240° C. Likewise, the apparent shear rate during melt processing may range from about 10 $seconds^{-1}$ to about 3000 $seconds^{-1}$, in some embodiments from about 50 $seconds^{-1}$ to about 2000 $seconds^{-1}$, and in some embodiments, from about 100 $seconds^{-1}$ to about 1200 $seconds^{-1}$. The apparent shear rate is equal to $4\ Q/\pi R^3$, where Q is the volumetric flow rate ("$m^3/s$") of the polymer melt and R is the radius of the capillary (e.g., extruder die) through which the molten polymer flows. Of course, other variables, such as the residence time during melt processing, which is inversely proportional to throughput rate, may also be controlled to achieve the desired degree of homogeneity. To achieve the desired shear conditions (e.g., rate, residence time, shear rate, melt processing temperature, etc.), the speed of the extruder screw(s) may be selected with a certain range. For example, the screw speed may range from about 50 revolutions per minute ("RPM") to about 300 RPM, in some embodiments from about 70 RPM to about 500 RPM, and in some embodiments, from about 100 RPM to about 300 RPM. The melt shear rate, and in turn, the degree to which the components are dispersed, may also be increased through the use of one or more distributive and/or dispersive mixing elements within the mixing section of the extruder. Suitable distributive mixers for single screw extruders may include, for instance, Saxon, Dulmage, Cavity Transfer mixers, etc. Likewise, suitable dispersive mixers may include Blister ring, Leroy/Maddock, CRD mixers, etc. As is well known in the art, the mixing may be further improved by using pins in the barrel that create a folding and reorientation of the polymer melt, such as those used in Buss Kneader extruders, Cavity Transfer mixers, and Vortex Intermeshing Pin (VIP) mixers.

III. Centrifugal Spinning System and Method

As mentioned above, any of a variety of known spinning techniques may be employed in the present invention to form fibers, such as melt spinning, solution spinning, etc. In one particular embodiment, centrifugal spinning techniques are employed that involve the formation of fibers by a process that includes the ejection of dissolved or molten polymer from a rotating member (e.g., spinneret or spin disc) that propels the polymer composition by centrifugal force into the form of fibers. If desired, air may also be supplied to help attenuate and direct the fibers as they are formed. The rotating member may rotate at a speed of, for example, from about 500 revolutions per minute ("RPM") to about 40,000 RPM, in some embodiments from about 1,000 RPM to about 30,000 RPM, in some embodiments, from about 2,500 RPM to about 20,000 RPM, and, in some embodiments, from about 5,000 RPM to about 10,000 RPM. If desired, the temperature of the rotating spin disk may also be controlled during fiber spinning. For example, the rotating spin disk temperature may range from about 100° C. to about 500° C., in some embodiments from about 125° C. to about 475° C., and in some embodiments, from about 150° C. to about 450° C.

During centrifugal spinning, the fibers are distributed away from the rotating spin disk onto a collection surface to form a coherent nonwoven web structure. The collection surface may vary as desired, and can be either stationary or moving during collection of the fibers. In one embodiment, for example, the collection surface may be provided on a conveyor belt, forming wire, or similar structure positioned vertically below the rotating spin disk and travelling in the machine direction, above which multiple centrifugal spinning chambers are disposed, as discussed in more detail below. In further embodiments, the collection surface can be a nonwoven material such as a meltblown or spunbond material.

Regardless of the particular nature of the spinning process, it is generally desired to apply an electrostatic charge to the collection surface to promote fiber formation at the surface. The collection surface may be charged directly, or indirectly, via a charged plate, such as a perforated forming plate or other entity in its vicinity. As described in more detail below, for instance, the collection surface can be charged relative to the perforated forming plates located along the machine direction of the collection surface. Any voltage source (e.g., high voltage direct current or unipolar radio frequency high voltage source) may generally be employed, and a separate voltage source is used to supply an electrostatic field to each of the multiple centrifugal spinning chambers, such as a first centrifugal spinning chamber and a second centrifugal spinning chamber. Each of the voltage sources may have variable voltage settings, such as from 10 kilovolts to about 80 kilovolts, such as from about 12.5 kilovolts to about 60 kilovolts, such as from about 15 kilovolts to about 40 kilovolts. Further, adjacent voltage sources are set such that one has a positive polarity setting (+) and the other has a negative polarity setting (−). For instance, when two centrifugal spinning chambers are utilized in the centrifugal spinning unit, the first centrifugal spinning chamber can have a positive voltage applied to the collection surface via a first perforated plate coupled to a positive voltage source, while the second centrifugal spinning chamber can have a negative voltage applied to the collection surface via a second perforated plate coupled to a negative voltage source, or vice versa. The current drawn in the charging process is typically small, such as about 10 mA or less.

The centrifugal spinning unit includes two or more rotating spin disks which receive a molten polymer or solution from which the fibrous sheet or web is formed. One embodiment of a rotating spin disk that can be used in the centrifugal spinning unit of the present invention is shown in FIG. 1A. The rotating spin disk 100 includes a body 120 having an upper surface 110. The body 120 acts as a reservoir which holds a spinning material (e.g., molten polymer or a polymer solution) to be spun into fibers. The upper surface 110 has an opening 112 to allow introduction of the material to be spun. The body 120 includes one or more orifices 122. In addition, a coupling member 160 is coupled to the body 120. The coupling member 160 may be used to couple the rotating spin disk 100 to a driver to rotate the rotating spin disk 100 can. Suitable drivers include commercially available variable electric motors, such as a brushless DC motor. Rotation of the rotating spin disk 100 causes material to be ejected through one or more orifices 122 to produce fibers. In some embodiments, the orifices 122 have a size and/or shape that causes the creation of nanofibers and/or microfibers as the material is ejected through the orifices.

Figure 1B:
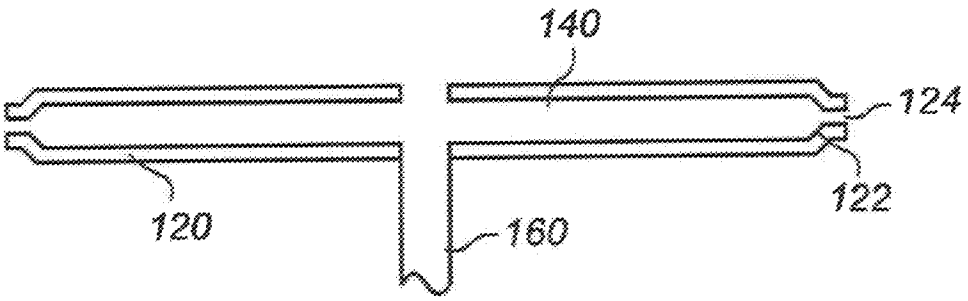

FIG. 1B depicts a cross-sectional side view of an embodiment of a rotating spin disk 100 that can be utilized in the system of the present invention. As shown, the body 120 of the rotating spin disk 100 can include a tip 124 located at the end of one or more orifices 122. The body 120 also defines a cavity 140 from which material flows toward each orifice 122 and is ejected out through the tip 124. The diameter and shape of the tip 124 can be chosen such that nanofibers and/or microfibers are produced when the material is ejected from the rotating spin disk 100.

Figure 2:
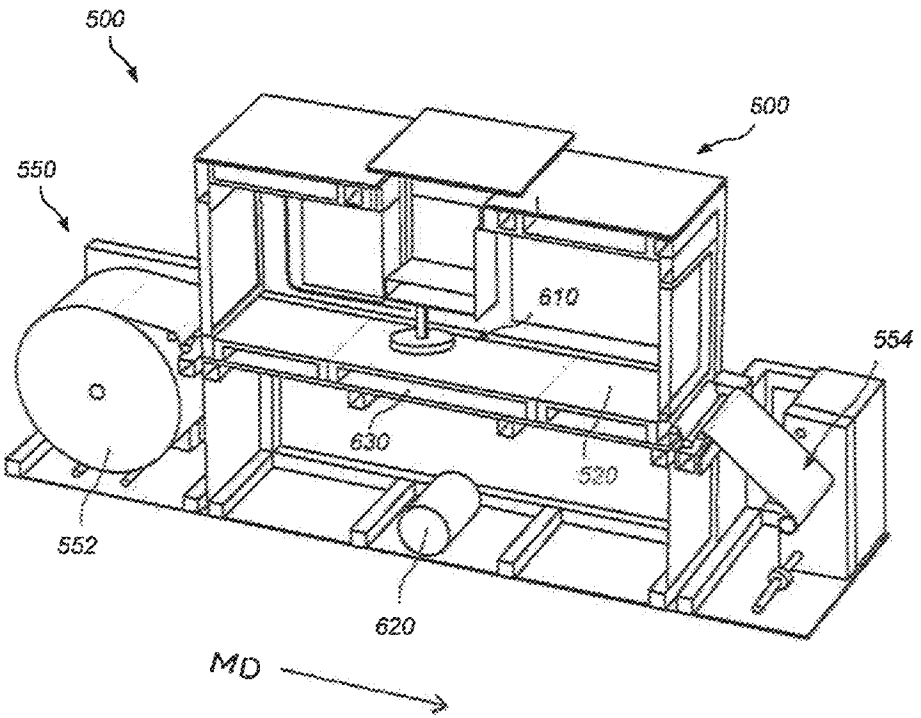
FIG. 2 illustrates one embodiment of a centrifugal spinning unit.

A top driven centrifugal spinning unit containing a rotating spin disk positioned vertically above a collection surface can be particularly useful for depositing fibers onto the collection surface to form a fibrous sheet or web, as shown in FIG. 2. The centrifugal spinning unit 500 includes a centrifugal spinning chamber 600 and a collection surface transfer system 550. The centrifugal spinning chamber 600 includes a top mounted rotating spin disk 610. The centrifugal spinning chamber 600 is configured to produce and direct fibers produced by the top mounted rotating spin disk 610 toward a collection surface 520 disposed below the top mounted rotating spin disk 610 during use. The collection surface transfer system 550 can move a continuous sheet of substrate material through the deposition system for collecting the fibers formed in the centrifugal spinning chamber 600.

Figure 3:
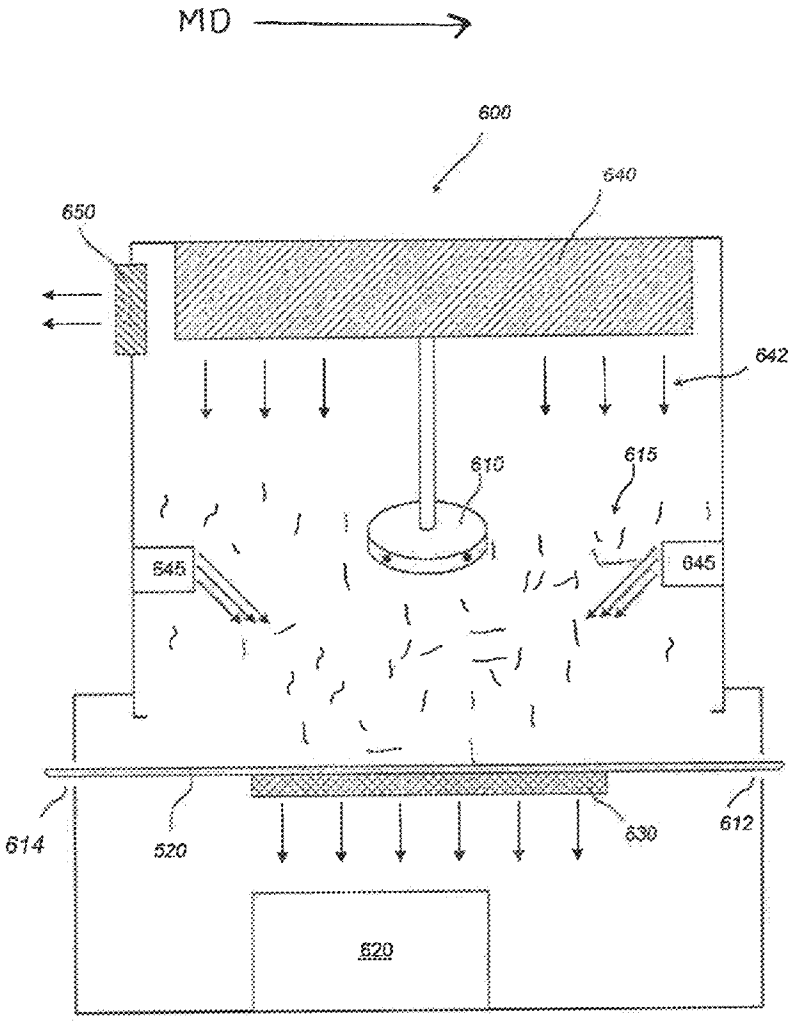
FIG. 3 illustrates one embodiment of a centrifugal spinning chamber.

The centrifugal spinning chamber 600 is shown in more detail in FIG. 3. The centrifugal spinning chamber 600 can include, for instance, a vacuum system 620, a forming plate 630, and a gas flow system 640. The vacuum 620 system can produce a region of reduced pressure under the collection surface 520 such that the fibers 615 produced by the top mounted rotating spin disk 610 are drawn toward the collection surface 520 due to the reduced pressure. Alternatively, one or more fans may be positioned under the collection surface 520 to create an air flow through the collection surface 520. Meanwhile, a gas flow system 640 can produce a gas flow 642 that directs fibers 615 formed by the top mounted rotating spin disk 610 toward the collection surface 520.

Further, the centrifugal spinning chamber 600 also includes a collection surface inlet 614 and a collection surface outlet 612 for facilitating the movement of the collection surface in the machine direction under the centrifugal spinning chamber 600 to collect fibers 615 formed by the top mounted rotating spin disk 610.

In addition, a forming plate 630 is positioned below the collection surface 520. The forming plate 630 is a plate capable of being charged to a predetermined polarity. Typically, fibers produced by the top mounted rotating spin disk 610 have a net charge. The net charge of the fibers may be positive or negative, depending on the type of material used. To improve deposition of charged fibers, an electrostatic plate may be disposed below collection surface 520 and be charged to an opposite polarity as the produced fibers. In this manner, the fibers are attracted to the forming plate 630 due to the electrostatic attraction between the opposite charges. The fibers 615 are thus collected onto the collection surface 520 as the fibers move toward the charged forming plate 630.

A pressurized gas producing and distribution system may be used to control the flow of fibers toward a collection surface disposed below the top mounted rotating spin disk in the chamber of the centrifugal spinning unit. Typically, the fibers produced by the rotating spin disk are dispersed within the centrifugal spinning chamber. The use of a pressurized gas producing and distribution system can help guide the fibers toward the collection surface. In one embodiment, a pressurized gas producing and distribution system includes a downward gas flow device 640 and a lateral gas flow device 645. The downward gas flow device 640 can be positioned above or even with the top mounted rotating spin disk 610 to facilitate even fiber movement toward the collection surface. Meanwhile, one or more lateral gas flow devices 645 can be oriented perpendicular to or below the top mounted rotating spin disk 610.

During use of the centrifugal spinning unit 500, the top mounted rotating spin disk 610 may produce various gases due to evaporation of solvents (during solution spinning) and material gasification (during melt spinning). Such gases can affect the quality of the fibers produced. Thus, the centrifugal spinning unit 500 can include an outlet fan 650 to remove gases produced during fiber production.

Turning now to the formation of a fibrous sheet or web from the fibers 615 produced by the top mounted rotating spin disk 610, the collection surface transfer system 550 can move a continuous sheet of a collection surface 520 through the centrifugal spinning chamber 600. The collection surface transfer system 550 includes a collection surface reel 552 and a collection surface take up reel system 554. During use, a roll of collection surface material is placed on collection surface reel 552 and threaded through the centrifugal spinning chamber 600 to the collection surface take up reel system 554. During use, the collection surface take up reel system 554 rotates, pulling the collection surface 520 through centrifugal spinning chamber 600. In this manner, a continuous roll of a collection surface material may be pulled through the centrifugal spinning chamber 600.

Figure 4:
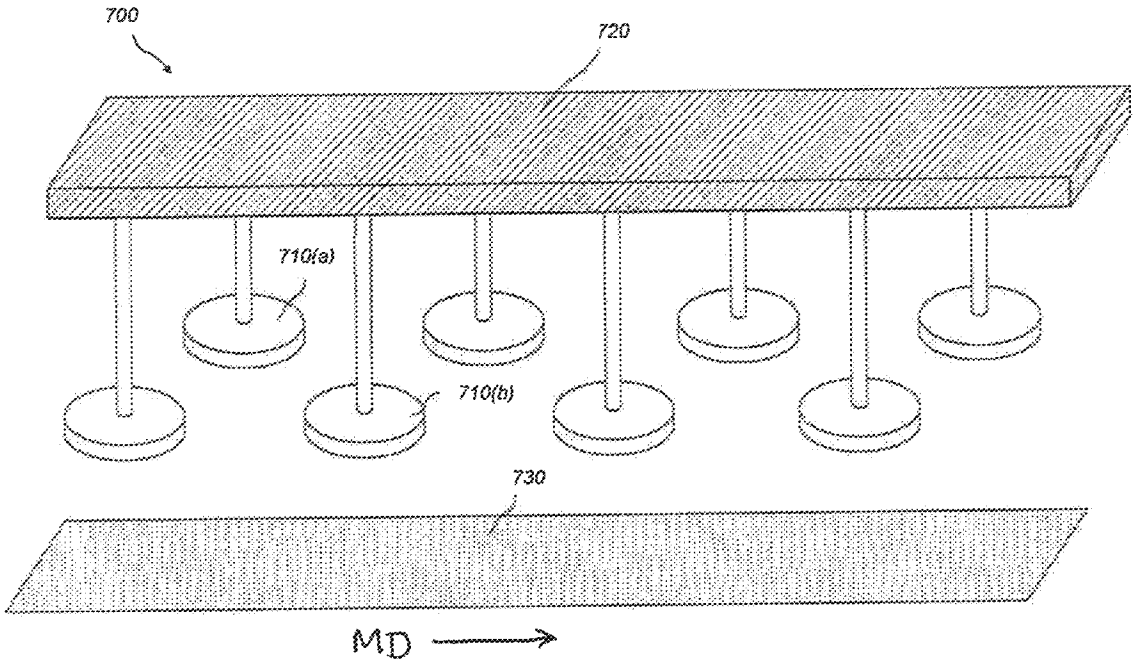
FIG. 4 illustrates a centrifugal spinning unit that includes multiple rotating spin disks.

In some embodiments, it may be difficult for a single rotating spin disk to produce a sufficient amount of fibers to form a fibrous sheet or web. In order to ensure adequate and even coverage of fibers on a collection surface, a centrifugal spinning unit may include two or more rotating spin disks, as generally depicted in FIG. 4, where a centrifugal spinning unit 700 may include two or more rotating spin disks 710 coupled to a driver unit 720.

The driver unit 720 is coupled to rotating spin disks 710. In one embodiment, driver unit 720 includes a plurality of drivers, each driver being coupled to a rotating spin disk 710. The drive unit 720 includes a controller capable of individually operating each of the drivers such that two or more of the rotating spin disks 710 substantially simultaneously produce fibers. In an alternate embodiment, the driver unit 720 includes a single driver that simultaneously operates all of the rotating spin disks 710 coupled to the driver unit 720. In such an embodiment, all of the fiber producing devices substantially simultaneously produce fibers to ensure complete coverage of the underlying collection 730.

Figure 5:
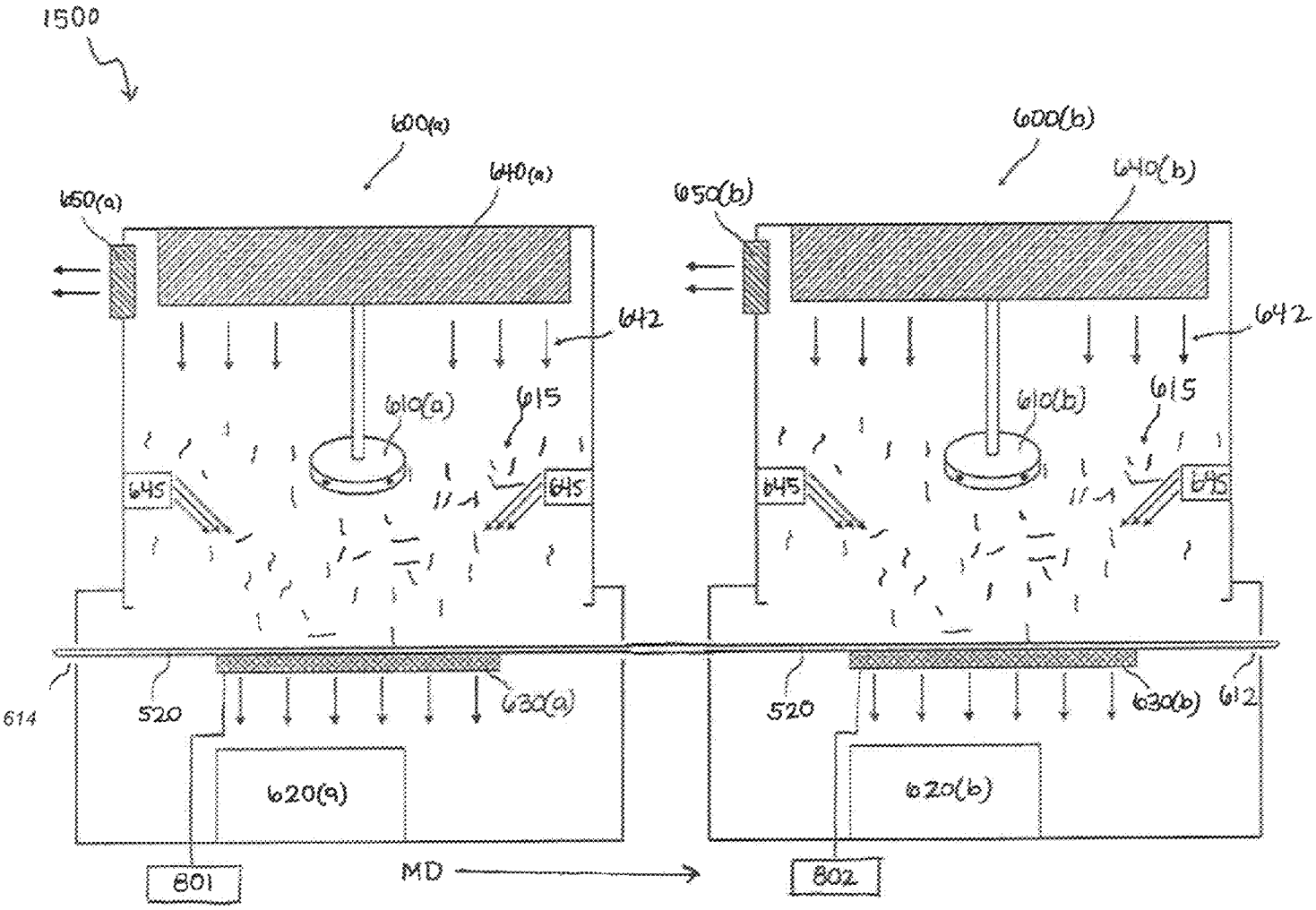
FIG. 5 illustrates a centrifugal spinning unit that includes two separate centrifugal spinning chambers arranged adjacent each other in the machine direction.

FIG. 5 depicts a centrifugal spinning unit 1500 containing two rotating spin disks 610(*a*) and 610(*b*). In particular, the rotating spin disks 610(*a*) and 610(*b*) are contained in two separate centrifugal spinning chambers 600(*a*) and 600(*b*), which are arranged adjacent each other in the machine direction MD of the centrifugal spinning unit 1500. A collection surface 520 is configured to move in the machine direction (MD) under the first and second rotating spin disks 610(*a*) and 610(*b*). Fibers 615 formed by the first and second rotating spin disks 610(*a*) and 610(*b*) are drawn to the moving collection surface 520 via first and second perforated forming plates 630(*a*) and 630(*b*), respectively. As the collection surface 520 moves from collection surface inlet 614 to collection surface outlet 612, a fibrous web is thus formed on the collection surface 520 due to the collection of fibers 615 at the locations on the collection surface 520 positioned above the first and second perforated forming plates 630(*a*) and 630(*b*).

To facilitate fiber lay down on the collection surface 520, the perforated forming plates 630(*a*) and 630(*b*) are applied with charges from different power supplies, where the second forming plate 630(*b*) is charged to a polarity that is opposite from the charge applied to the first forming plate 630(*a*). For instance, the first perforated forming plate 630(*a*) in the first centrifugal spinning chamber 600(*a*) can be applied with a positive charge from a positive voltage source 801, while the second perforated forming plate 630(*b*) in the second centrifugal spinning chamber 600(*b*) can be applied with a negative charge from a negative voltage source 802. It is also to be understood that the polarities can be reversed, where the first perforated forming plate can be applied with a negative charge from a negative voltage source and the second perforated forming plate can be applied with a positive charge from a positive voltage source. Any suitable voltage source (e.g., high voltage direct current or unipolar radio frequency high voltage source) may generally be employed to supply an electrostatic field to each of the first and second centrifugal spinning chambers 600(*a*) and 600(*b*) via the perforated forming plates 630(*a*) and 630(*b*), respectively. The voltage applied from each of the voltage sources 801 and 802 can range from 10 kilovolts to about 80 kilovolts, such as from about 12.5 kilovolts to about 60 kilovolts, such as from about 15 kilovolts to about 40 kilovolts. Because the centrifugal spinning chambers 600(*a*) and 600(*b*) include forming plates 630(*a*) and 630(*b*) that have opposing charges, the present inventors have discovered that a fibrous sheet or web can be formed having minimal defects as compared to a fibrous sheet or web formed when the forming plates have the same charge.

Further, as shown in FIG. 5, each of the centrifugal spinning chambers 600(*a*) and 600(*b*) can have separate vacuum systems 620(*a*) and 620(*b*), separate gas flow systems 640(*a*) and 640(*b*), and separate outlet fans 650(*a*) and 650(*b*). However, it is to be understood that this is not required, and, instead, the centrifugal spinning chambers 600(*a*) and 600(*b*) be configured to utilize the same vacuum system, gas flow system, and/or outlet fan.

Figure 6:
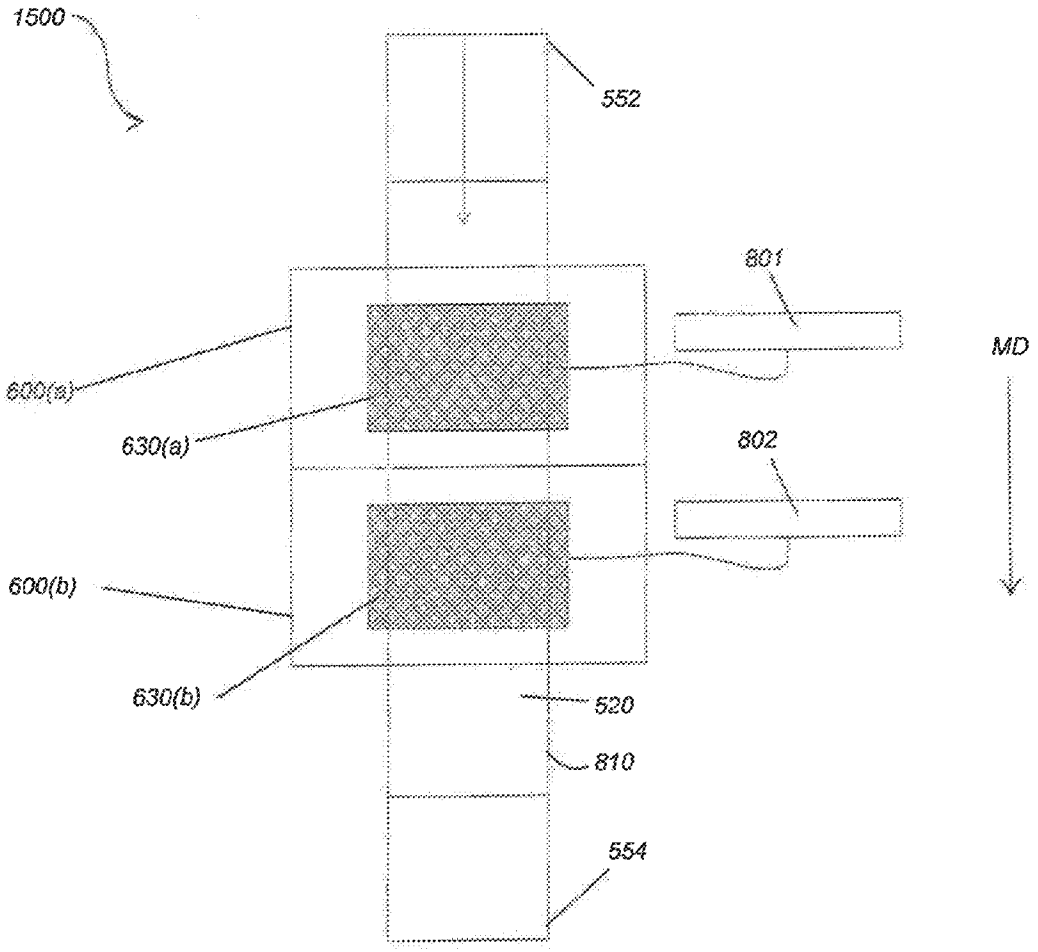
FIG. 6 is a top view of a portion of a centrifugal spinning unit that includes two separate centrifugal spinning chambers arranged adjacent each other in the machine direction.

Turning now to FIG. 6, a top view of a portion of a centrifugal spinning unit 1500 that includes two separate centrifugal spinning chambers 600(*a*) and 600(*b*) arranged adjacent each other in the machine direction MD is shown. The centrifugal spinning unit 1500 includes a metal sheet 810 disposed along the machine direction. As a fibrous sheet or web formed from the centrifugal spinning unit 1500 exits the second centrifugal spinning chamber 600(*b*) and travels in the machine direction MD, the fibrous sheet or web travels over the metal sheet 810, which is grounded and disposed below the moving collection surface 520 and in parallel therewith. The placement of the metal sheet 810 where a fibrous sheet or web exits the centrifugal spinning chambers can dissipate the static charge on the fibrous sheet or web caused by forming fibers via the perforated forming plates 630(*a*) and 630(*b*) within each of the centrifugal spinning chambers 600(*a*) and 600(*b*). Such a configuration can eliminate defects in the fibrous sheet or web caused by the attraction of the fibrous sheet or web to the surface of the centrifugal spinning unit 1500, which is grounded. After passing over the metal sheet 810, the collection surface 520 containing the fibrous sheet or web can be wound into a roll on a winder. Further, it is to be understood that instead of utilizing metal sheet 810 to dissipate charge, a drawbar can be used instead.

Although FIGS. 5 and 6 show two centrifugal spinning chambers and two rotating spin disks, it is to be understood that the present invention also contemplates a centrifugal spinning unit that utilizes more than two centrifugal spinning chambers, with each chamber having a designated rotating spin disk and a designated forming plate. For instance, the centrifugal spinning unit system of the present invention can include 3, 4, 5, 6, 7, 8, or more centrifugal spinning chambers. Regardless of the number of centrifugal spinning chambers utilized in the centrifugal spinning unit, adjacent centrifugal spinning chambers have forming plates charged to opposing polarities to minimize the occurrence of defects in the fibrous sheets or webs formed therefrom. For instance, if the centrifugal spinning unit includes four centrifugal spinning chambers arranged adjacent each other in the machine direction, the first and third centrifugal spinning chambers will each include a forming plate charged to one polarity (e.g., positively charged), while the second and fourth centrifugal spinning chambers will each include a forming plate charged to the opposing polarity (e.g., negatively charged).

As mentioned above, the system and method of the present invention are utilized to form substantially defect free fibrous sheet or web containing nanofibers, microfibers, or a combination thereof, Although the figures are directed to a system utilizing centrifugal spinning chambers, it is to be understood that the system can also utilized at least two meltblown fiber-drawing devices or at least two spunbond fiber-drawing devices, each associated with a charged forming plate having an opposite polarity from adjacent charged forming plates. Typically, the resulting fibrous web is a "nonwoven" web to the extent that individual fibers are randomly interlaid, not in an identifiable manner as in a knitted fabric. The basis weight of the fiber web may generally vary, but is typically from about 1 gram per square meter ("gsm") to 150 gsm, in some embodiments from about 2 gsm to about 100 gsm, and in some embodiments, from about 5 gsm to about 50 gsm. Due to passing the fibrous sheet or web over the charged surfaces (e.g., the charged forming plates, metal, sheet, and/or drawbar), the resulting fibrous sheet or web can include an electret treatment, which can improve the filtration performance of the fibrous sheet or web as compared to a fibrous sheet or web that is formed on an uncharged surface.

If desired, the fibers in the fibrous sheet or web may also be employed in a composite that contains a combination of the fibers with other types of fibers (e.g., staple fibers, filaments, etc.). For example, additional synthetic fibers may be utilized, such as those formed from polyolefins (e.g., polyethylene, polypropylene, polybutylene, etc.); polytetrafluoroethylene; polyesters (e.g., polyethylene terephthalate, polylactic acid, etc.); polyamides (e.g., nylon); polyvinyl chloride; polyvinylidene chloride; polystyrene; and so forth. The composite may also contain pulp fibers, such as high-average fiber length pulp, low-average fiber length pulp, or mixtures thereof. One example of suitable high-average length fluff pulp fibers includes softwood kraft pulp fibers. Low-average length fibers may also be used in the composite. An example of suitable low-average length pulp fibers is hardwood kraft pulp fibers. Such composites may be formed using a variety of known techniques. The relative percentages of the additional fibers may vary over a wide range depending on the desired characteristics of the composite. For example, the composite may contain from about 1 wt. % to about 60 wt. %, in some embodiments from 5 wt. % to about 50 wt. %, and in some embodiments, from about 10 wt. % to about 40 wt. % fibers of the present invention, as well as from about 40 wt. % to about 99 wt. %, in some embodiments from 50 wt. % to about 95 wt. %, and in some embodiments, from about 60 wt. % to about 90 wt. % additional fibers.

If desired, the fibrous sheet or web may also be employed in a multi-layered laminate structure. The other layers of the laminate may include a nonwoven web (e.g., a melt-spun web, such as a meltblown or spunbond web), film, strands, etc.

In one embodiment, for example, the laminate may contain a fibrous sheet or web positioned between two spunbond webs. Various techniques for forming laminates of this nature are described in U.S. Pat. No. 4,041,203 to Brock et al.; U.S. Pat. No. 5,213,881 to Timmons et al.; U.S. Pat. No. 5,464,688 to Timmons, et al.; U.S. Pat. No. 4,374,888 to Bornslaeger; U.S. Pat. No. 5,169,706 to Collier, et al.; and U.S. Pat. No. 4,766,029 to Brock, et al. Of course, the laminate may have other configurations and possess any desired number of layers, such as a spunbond/fiber web/meltblown web/spunbond laminate, spunbond/fiber web laminate, etc. In yet another embodiment, the laminate may include a fibrous sheet or web positioned adjacent to a film. Any known technique may be used to form a film, including blowing, casting, flat die extruding, etc. The film may be a mono- or multi-layered film. Any of a variety of polymers may generally be used to form a melt-spun nonwoven web or film used in the laminate structure, such as polyolefins (e.g., polyethylene, polypropylene, polybutylene, etc.); polytetrafluoroethylene; polyesters (e.g., polyethylene terephthalate, polylactic acid, etc.); polyamides (e.g., nylon); polyvinyl chloride; polyvinylidene chloride; polystyrene; and so forth.

III. Articles

The fibrous webs or sheets of the present invention may be used in a wide variety of applications. For example, the fibers may be incorporated into filtration media, medical products, such as gowns, surgical drapes, facemasks, head coverings, surgical caps, shoe coverings, sterilization wraps, warming blankets, heating pads, etc., absorbent articles, filtration media, and so forth. For example, the fibers may be incorporated into an "absorbent article" that is capable of absorbing water or other fluids. Examples of some absorbent articles include, but are not limited to, personal care absorbent articles, such as diapers, training pants, absorbent underpants, incontinence articles, feminine hygiene products (e.g., sanitary napkins), swim wear, baby wipes, mitt wipe, and so forth; medical absorbent articles, such as garments, fenestration materials, underpads, bedpads, bandages, absorbent drapes, and medical wipes; food service wipers; clothing articles; pouches, and so forth.

Materials and processes suitable for forming such articles are well known to those skilled in the art. Absorbent articles, for instance, typically include a substantially liquid-impermeable layer (e.g., outer cover), a liquid-permeable layer (e.g., topsheet, surge management layer, ventilation layer, wrap, etc.), and an absorbent core. The topsheet, for instance, is generally employed to help isolate the wearer's skin from liquids held in the absorbent core. Due to its proximity to the skin, a fibrous web is generally employed in the topsheet to provide a cloth-like feeling. If desired, the fibrous web used in the topsheet may be formed from the fibers of the present invention. The outer cover is likewise designed to be liquid-impermeable, but yet typically permeable to gases and water vapor (i.e., "breathable"). This permits vapors to escape from the absorbent core, but still prevents liquid exudates from passing through the outer cover. While the outer cover generally contains a film to impart the desired impermeability to liquids, a fibrous web is often laminated to the film as a facing to impart a more cloth-like feeling. If desired, the fibrous web used in the outer cover may be formed from the fibers of the present invention.

In yet another embodiment, the fibers formed as described in the present invention may be incorporated into a wipe configured for use on skin, such as a baby wipe, adult wipe, hand wipe, face wipe, cosmetic wipe, household wipe, industrial wipe, personal cleansing wipe, cotton ball, cotton-tipped swab, and so forth. The wipe may assume a variety of shapes, including but not limited to, generally circular, oval, square, rectangular, or irregularly shaped. Each individual wipe may be arranged in a folded configuration and stacked one on top of the other to provide a stack of wet wipes. Such folded configurations are well known to those skilled in the art and include c-folded, z-folded, quarter-folded configurations and so forth. For example, the wipe may have an unfolded length of from about 2.0 to about 80.0 centimeters, and in some embodiments, from about 10.0 to about 25.0 centimeters. The wipes may likewise have an unfolded width of from about 2.0 to about 80.0 centimeters, and in some embodiments, from about 10.0 to about 25.0 centimeters. The stack of folded wipes may be placed in the interior of a container, such as a plastic tub, to provide a package of wipes for eventual sale to the consumer. Alternatively, the wipes may include a continuous strip of material which has perforations between each wipe and which may be arranged in a stack or wound into a roll for dispensing. The wipe may be a "wet wipe" in that it contains a solution for cleaning, disinfecting, sanitizing, etc. The particular wet wipe solutions are not critical to the present invention and are described in more detail in U.S. Pat. No. 6,440,437 to Krzysik, et al.; U.S. Pat. No. 6,028,018 to Amundson, et al.; U.S. Pat. No. 5,888,524 to Cole; U.S. Pat. No. 5,667,635 to Win, et al.; U.S. Pat. No. 5,540,332 to Kopacz, et al.; and U.S. Pat. No. 4,741,944 to Jackson, et al. The amount of the wet wipe solution employed may depending upon the type of wipe material utilized, the type of container used to store the wipes, the nature of the cleaning formulation, and the desired end use of the wipes. Generally, each wipe contains from about 150 to about 600 wt. % and desirably from about 300 to about 500 wt. % of a wet wipe solution based on the dry weight of the wipe. When employed, the cleaning formulation is typically kept at the second pH level so as not to have a substantial adverse impact on the integrity of the fibers.

In still another embodiment, the fibrous web formed by the methods of the present invention may be employed alone or in combination with other materials to form a filtration media. In one embodiment, for example, the filtration media may be a multi-layered laminate structure containing at least one layer formed from the fibrous web of the present invention. Apart from the fibrous web of the present invention, additional layers of the laminate may include a nonwoven web (e.g., a melt-spun web, such as a meltblown or spunbond web), film, strands, etc. In one embodiment, for example, the laminate may contain the fibrous web of the present invention positioned between two spunbond webs. Various techniques for forming laminates of this nature are described in U.S. Pat. No. 4,041,203 to Brock et al.; U.S. Pat. No. 5,213,881 to Timmons, et al.; U.S. Pat. No. 5,464,688 to Timmons, et al.; U.S. Pat. No. 4,374,888 to Bornslaeger; U.S. Pat. No. 5,169,706 to Collier, et al.; and U.S. Pat. No. 4,766,029 to Brock et al. Of course, the laminate may have other configurations and possess any desired number of layers, such as a spunbond/fibrous web/meltblown web/spunbond laminate, spunbond/fibrous web laminate, etc. In yet another embodiment, the laminate may include the fibrous web positioned adjacent to a film. Any known technique may be used to form a film, including blowing, casting, flat die extruding, etc. The film may be a mono- or multi-layered film, which may or may not be aperture to increase gas or liquid permeability. Any of a variety of polymers may generally be used to form a melt-spun nonwoven web or film used in the laminate structure, such as polyolefins (e.g., polyethylene, polypropylene, polybutylene, etc.); polytetrafluoroethylene; polyesters (e.g., polyethylene terephthalate, polylactic acid, etc.); polyamides (e.g., nylon); polyvinyl chloride; polyvinylidene chloride; polystyrene; and so forth. The basis weight of the composite filtration media may generally vary, but is typically from about 20 gsm to about 200 gsm, in some embodiments from about 30 gsm to about 150 gsm, and in some embodiments, from about 40 gsm to about 100 gsm. The composite may also be subjected to an electret treatment in the manner described above.

Regardless of its particular structure, the resulting filtration media may be employed in a wide variety of applications, such as in medical products (e.g., facemasks, wound dressings, sterilization wraps, etc.), vacuum cleaner bags, respirators, air filters (e.g., for engines), heating and/or air conditioner filters, water filters, and so forth.

The present invention may be better understood with reference to the following examples.

Example 1

A fibrous web was formed by dry blending a polypropylene masterbatch. The blend contained 98 wt % polypropylene (Metocene™ MF650Y, Basell Polyolefins), 1.5 wt % peroxide, and 0.5 wt. % sodium stearate. Once formed, the dry-blend was poured in a dry state into the hopper of a centrifugal spinning system (FibeRio® Technology Corporation), which spun the blend into a fibrous web utilizing two centrifugal spinning chambers. The temperature of the extrusion zones of the centrifugal spinning system ranged from 185° C. to 240°

C. and the temperature of the hot runner (which flows the melt into the spinneret) was 240° C. Further, the flow rate from the melt pump into the hot runner was 8 milliliters per minute. The spinneret also rotated at a rate of 6000 RPM and was set to a temperature of 440° C. The first centrifugal spinning chamber included a perforated forming plate having a positive charge of 20 kilovolts and the second centrifugal spinning chamber included a performed forming plate having a negative charge of 20 kilovolts. The resulting fibrous web contained fewer defects as compared to a fibrous web having a positive charge applied to the first centrifugal spinning chamber and the second centrifugal spinning chamber via the perforated forming plates.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A fiber-forming system for forming a fibrous web, the system comprising:

a collection surface;

a first fiber-forming device comprising a charged first forming plate positioned beneath the collection surface; and a second fiber-forming device comprising a charged second forming plate positioned beneath the collection surface, wherein the first forming plate and the second forming plate exhibit opposing charge polarities.

2. The fiber-forming system of claim 1, wherein the first fiber-forming device is a first centrifugal spinning chamber comprising a first rotating spin disk, and the second fiber-forming device is a second centrifugal spinning chamber comprising a second rotating spin disk.

3. The fiber-forming system of claim 1, further comprising a first voltage source, wherein the first voltage source is coupled to the first forming plate.

4. The fiber-forming system of claim 1, further comprising a second voltage source, wherein the second voltage source is coupled to the second forming plate.

5. The fiber-forming system of claim 1, wherein the first forming plate and the second forming plate are perforated.

6. The fiber-forming system of claim 1, wherein the first forming plate has a positive charge and the second forming plate has a negative charge.

7. The fiber-forming system of claim 6, wherein the first forming plate is applied with a first voltage ranging from about 10 kilovolts to about 80 kilovolts, and the second forming plate is applied with a second voltage ranging from about −10 kilovolts to about −80 kilovolts.

8. The fiber-forming system of claim 1, wherein the first forming plate has a negative charge and the second forming plate has a positive charge.

9. The fiber-forming system of claim 8, wherein the first forming plate is applied with a first voltage ranging from about −10 kilovolts to about −80 kilovolts, and the second forming plate is applied with a second voltage ranging from about 10 kilovolts to about 80 kilovolts.

10. The fiber-forming system of claim 2, wherein the first rotating spin disk and the second rotating spin disk are each defined by a cavity and one or more orifices, where rotation of the first rotating spin disk and the second rotating spin disk causes material to be ejected through the one or more orifices to produce fibers.

11. The fiber-forming system of claim 1, wherein the fiber spinning system forms a fibrous web containing nanofibers, microfibers, or a combination thereof.

12. The fiber-forming system of claim 1, wherein the collection surface is configured to pass above a metal sheet after the collection surfaces passes under the second fiber-forming device.

13. The fiber-forming system of claim 1, wherein the first fiber-forming device and the second fiber-forming device comprise spunbond or meltblown fiber-drawing devices.

14. A method for forming a fibrous web on a collection surface via a fiber-forming system, the method comprising:

introducing a first material to a first fiber-forming device and introducing a second material to a second fiber-forming device;

positioning a first forming plate beneath the collection surface, wherein the first forming plate is associated with the first fiber-forming device;

charging the first forming plate to a first charge via a first voltage source;

positioning a second forming plate beneath the collection surface, wherein the second forming plate is associated with the second fiber-forming device;

charging the second forming plate to a second charge via a second voltage source, wherein the first forming plate and the second forming plate exhibit opposing charge polarities;

drawing a first group of fibers from the first fiber-forming device and a second group of fibers from the second fiber-forming device; and collecting the first group of fibers and the second group of fibers on the collection surface.

15. The method of claim 14, wherein the first fiber-forming device is a first centrifugal spinning chamber comprising a first rotating spin disk, and the second fiber-forming device is a second centrifugal spinning chamber comprising a second rotating spin disk, wherein drawing fibers from the first fiber-forming device and the second fiber-forming device comprises:

rotating the first rotating spin disk to eject the first material through one or more orifices located on the first rotating spin disk to produce a first group of fibers; and rotating the second rotating spin disk to eject the second material through one or more orifices located on the second rotating spin disk to produce a second group of fibers.

16. The method of claim 14, wherein the first material and the second material comprise a molten polymer composition or an aqueous polymer solution.

17. The method of claim 14, wherein the collection surface travels beneath the first fiber-forming device and then the second fiber-forming device in a machine direction.

18. The method of claim 17, wherein the second group of fibers are disposed above the first group of fibers.

19. The method of claim 14, wherein the first forming plate has a positive charge and the second forming plate has a negative charge.

20. The method of claim 19, wherein the first forming plate is applied with a first voltage ranging from about 10 kilovolts to about 80 kilovolts, and the second forming plate is applied with a second voltage ranging from about −10 kilovolts to about −80 kilovolts.

21. The method of claim 14, wherein the first forming plate has a negative charge and the second forming plate has a positive charge.

22. The method of claim 21, wherein the first forming plate is applied with a first voltage ranging from about −10 kilovolts to about −80 kilovolts, and the second forming plate is applied with a second voltage ranging from about 10 kilovolts to about 80 kilovolts.

23. The method of claim 15, wherein the first rotating spin disk and the second rotating spin disk rotate at a speed ranging from about 500 revolutions per minute to about 40,000 revolutions per minute.

24. The method of claim 14, wherein the collection surface is configured to pass above a metal sheet after the collection surface passes through the second fiber-forming device.

25. The method of claim 14, wherein the first group of fibers and the second group of fibers comprise nanofibers, microfibers, or a combination thereof.

26. The method of claim 14, wherein the first fiber-forming device and the second fiber-forming device comprise spunbond or meltblown fiber-drawing devices.

* * * * *